US009060555B1

(12) United States Patent
Harris et al.

(10) Patent No.: US 9,060,555 B1
(45) Date of Patent: Jun. 23, 2015

(54) CLOTHING WITH RETENTION STRUCTURE IN POCKET

(71) Applicants: Bryan Scott Harris, Racine, OH (US); Christopher Michael Roush, Racine, OH (US)

(72) Inventors: Bryan Scott Harris, Racine, OH (US); Christopher Michael Roush, Racine, OH (US)

( * ) Notice: Subject to any disclaimer, the term of this patent is extended or adjusted under 35 U.S.C. 154(b) by 0 days.

(21) Appl. No.: 14/154,466

(22) Filed: Jan. 14, 2014

Related U.S. Application Data

(60) Provisional application No. 61/752,919, filed on Jan. 15, 2013.

(51) Int. Cl.
*A41D 27/20* (2006.01)

(52) U.S. Cl.
CPC ..... *A41D 27/20* (2013.01)

(58) Field of Classification Search
CPC ..... A42B 1/24; A42B 1/241; A42B 11/006; A41D 13/0593; A41D 19/002; A41D 27/20; A41D 27/204; A41D 27/205; A41D 27/207; A41D 27/22; A41D 2400/80
USPC ..... 2/247, 249–251, 271, 253
See application file for complete search history.

(56) References Cited

U.S. PATENT DOCUMENTS

| | | | | | |
|---|---|---|---|---|---|
| 1,692,200 | A * | 11/1928 | Capuano | ..... | 2/249 |
| 2,634,422 | A * | 4/1953 | Cantrell | ..... | 2/271 |
| 4,791,681 | A * | 12/1988 | Dean | ..... | 2/106 |
| 4,896,377 | A * | 1/1990 | Ferdi | ..... | 2/115 |
| 5,082,157 | A | 1/1992 | Emerson-Santos | | |
| 2008/0148467 | A1 * | 6/2008 | Sugiura | ..... | 2/271 |

* cited by examiner

*Primary Examiner* — Gloria Hale
(74) *Attorney, Agent, or Firm* — The Law Office of Patrick F. O'Reilly III, LLC

(57) ABSTRACT

A clothing pocket structure including a first sheet of fabric at least partially spaced apart from a second sheet of fabric, the first and second sheets of fabric together at least partially defining a semi-enclosed volume; and a retention device disposed between the first and second sheets of fabric, first and second side portions of the retention device being attached to one of the first and second sheets of fabric, a middle portion of the retention device being at least partially spaced apart from the one of the first and second sheets of fabric to which the retention device is attached so as to define a securement space between the retention device and the one of the first and second sheets of fabric, and the securement space being generally open at a top edge of the retention device so as to permit the passage of a device therein.

20 Claims, 13 Drawing Sheets

Section A-A

CLOTHING WITH RETENTION STRUCTURE IN POCKET

CROSS-REFERENCE TO RELATED APPLICATIONS

This patent application claims priority to, and incorporates by reference in its entirety, U.S. Provisional Patent Application No. 61/752,919, entitled "Clothing With Retention Structure In Pocket", filed on Jan. 15, 2013.

BACKGROUND OF THE INVENTION

1. Field of the Invention

The invention relates to clothing, and more specifically to methods and apparatuses for retaining items in pockets.

2. Background and Description of Related Art

Articles of clothing, such as pants and shirts, often include one or more pockets for holding various devices and objects, such as wallets, currency, mobile phones, etc. However, it is relatively common for the objects and devices being stowed in these conventional pockets to become inadvertently dislodged therefrom. This is particularly true when the person wearing the article of clothing with the one or more pockets is riding on a vehicle that is traversing rough terrain with many sudden bumps. For example, if the person is riding on an off-road vehicle, such as an all-terrain vehicle (ATV), the wallet or mobile phone disposed in the pocket of the wearer can easily be jarred loose from the confines of the pocket, and thus, be inadvertently lost forever.

U.S. Pat. No. 5,082,157 discloses an easily accessible concealed pocket. A belt passes through the belt loop and the container portion has a pocket opening which is vertically aligned with the belt loop and the belt. The pocket is received between an article of clothing and the wearer such that the belt forces the article of clothing inwardly against the wearer to close the pocket opening. In this way, the pocket is concealed within the article of clothing. When it is desired to remove valuables from the container, the wearer merely moves the belt outwardly, and has access to the container. Although, the device disclosed in U.S. Pat. No. 5,082,157 operates as an accessory to articles of clothing, but does not attempt to remedy the deficiencies of conventional pockets provided in the articles of clothing themselves.

Therefore, what is needed is an article of clothing with a retention structure disposed in a pocket thereof that is capable of securely retaining objects within the confines of the pocket so as to prevent the objects from becoming inadvertently dislodged therefrom. Moreover, a pocket retention structure is needed that can be easily integrated into the pockets of various articles of clothing. Furthermore, there is a need for a pocket retention structure that is compact, and thus, does not occupy an undue portion of the overall pocket volume.

BRIEF SUMMARY OF EMBODIMENTS OF THE INVENTION

Accordingly, the present invention is directed to a pocket with a retention device or structure and an article of clothing with a retention device or structure disposed in the pocket thereof that substantially obviates one or more problems resulting from the limitations and deficiencies of the related art.

In accordance with one or more embodiments of the present invention, there is provided an article of clothing that includes: a pocket structure, the pocket structure including a first sheet of fabric at least partially spaced apart from a second sheet of fabric, the first and second sheets of fabric together at least partially defining a semi-enclosed volume; and a retention device disposed between the first and second sheets of fabric, the retention device having a top edge, a bottom edge, a first side portion, a second side portion, and a middle portion, the first and second side portions of the retention device being attached to one of the first and second sheets of fabric, the middle portion of the retention device being at least partially spaced apart from the one of the first and second sheets of fabric to which the retention device is attached so as to define a securement space between the retention device and the one of the first and second sheets of fabric, and the securement space being generally open at the top edge of the retention device so as to permit the passage of a device into the securement space.

In a further embodiment of the present invention, the bottom edge of the retention device is generally open so as to permit the device to protrude slightly from the bottom edge of the retention device.

In yet a further embodiment, the retention device has a generally inverted trapezoidal shape.

In still a further embodiment, the retention device further comprises side edges extending between the top edge and the bottom edge, the side edges being inwardly tapered from the top edge to the bottom edge.

In yet a further embodiment, the retention device has a generally flat bottom V-shape.

In still a further embodiment, the second sheet of fabric is an inner sheet of fabric on the article of clothing, and the retention device is attached to the second sheet of fabric.

In yet a further embodiment, the retention device is attached to the second sheet of fabric by means of stitching on the first and second side portions thereof.

In still a further embodiment, the first sheet of fabric is an outer sheet of fabric on the article of clothing, and the retention device is attached to the first sheet of fabric.

In yet a further embodiment, the retention device is attached to the first sheet of fabric by means of stitching on the first and second side portions thereof.

In still a further embodiment, the article of clothing is selected from the group consisting of: pants, a shirt, a hooded sweatshirt, shorts, a coat, a hooded jacket, a skirt, a dress, jeans, sweat pants, dress pants, a polo shirt, and a dress shirt.

In accordance with one or more other embodiments of the present invention, there is provided a pocket on an article of clothing, the pocket including: a wall, the wall at least partially closing a volume; and a retention member extending between two ends, wherein each end of the retention member is fixed to the wall in the volume.

In a further embodiment of the present invention, the retention member has a generally inverted trapezoidal shape.

In yet a further embodiment, the retention member has a generally flat bottom V-shape.

In still a further embodiment, the retention member is formed from a resilient material.

In accordance with yet one or more other embodiments of the present invention, there is provided a clothing apparatus that includes: a pocket including at least one side wall; and a resilient band that is secured to the at least one side wall of the pocket at two ends of the band.

In a further embodiment of the present invention, the length of the band under tension or without tension is within one of the following ranges: (i) approximately ½ to approximately 1 inch; (ii) approximately ½ to approximately 3 inches; (iii) approximately 1 to approximately 3 inches; and (iv) approximately 2 to approximately 4 inches.

In yet a further embodiment, the width of the band is within one of the following ranges: (i) approximately ⅛ to approximately ½ inch; (ii) approximately ¼ to approximately ½ inch; (iii) approximately ¼ to approximately 1 inch; (iv) approximately ½ to approximately 1 inch; (v) approximately ½ to approximately 2 inches; and (vi) approximately 2 to approximately 3½ inches.

In still a further embodiment, the band is formed from a material selected from the group consisting of: woven elastic, knitted elastic, elastic netting, neoprene, or another stretchable material comprising rubber or polymer.

In yet a further embodiment, the band is formed from a material having an elastic modulus that is within one of the following ranges: (i) approximately 0.00001 to approximately 1 gigapascals; (ii) approximately 0.0001 to approximately 0.01 gigapascals; (iii) approximately 0.0001 to approximately 0.1 gigapascals; (iv) approximately 0.0001 to approximately 0.145 gigapascals; (v) approximately 0.001 to approximately 0.5 gigapascals; and (vi) approximately 0.001 to approximately 1 gigapascals.

In still a further embodiment, the article of clothing is selected from the group consisting of: pants, a shirt, a hooded sweatshirt, shorts, a coat, a hooded jacket, a skirt, a dress, jeans, sweat pants, dress pants, a polo shirt, and a dress shirt.

It is to be understood that the foregoing general description and the following detailed description of the present invention are merely exemplary and explanatory in nature. As such, the foregoing general description and the following detailed description of the invention should not be construed to limit the scope of the appended claims in any sense.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF EXEMPLARY EMBODIMENTS

Figure 1:
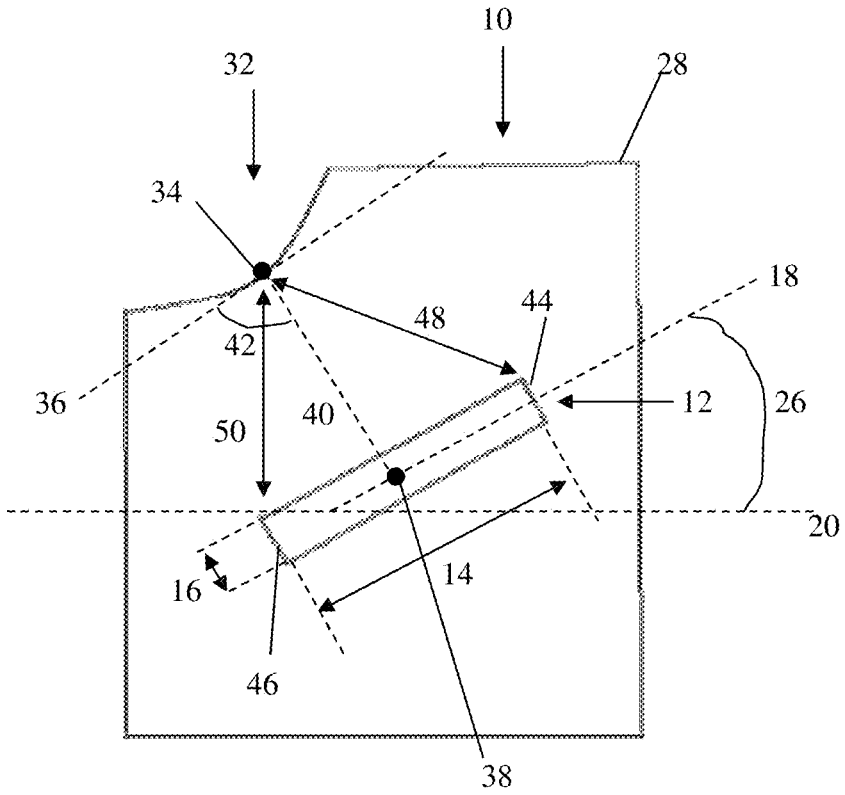
FIG. 1 is a front, planar view of a first exemplary embodiment of the invention.

A plurality of different embodiments of the invention is shown in the Figures of the application. Similar features are shown in the various embodiments of the invention. Similar features have been numbered with a common reference numeral and have been differentiated by an alphabetic suffix. Also, to enhance consistency, the structures in any particular drawing share the same alphabetic suffix even if a particular feature is shown in less than all embodiments. Similar features are structured similarly, operate similarly, and/or have the same function unless otherwise indicated by the drawings or this specification. Furthermore, particular features of one embodiment can replace corresponding features in another embodiment or can supplement other embodiments unless otherwise indicated by the drawings or this specification.

Referring now to the drawings wherein the showings are for purposes of illustrating embodiments of the invention only and not for purposes of limiting the same, and wherein like reference numerals are understood to refer to like components, FIG. 1 shows an inside of a pocket 10 laid flat, without the top sheet 30 (shown in FIG. 2), with a retention device or band 12 secured to the inside of the pocket 10. The band 12 has a length 14 and a width 16. The band 12 is secured to the pocket 10 at both ends 44, 46 of its length 14. The band 12 is resilient, which means it can stretch when under tension and return to its original length when the tension is removed.

In alternative embodiments of the invention, the band's length 14 without tension or under tension can be within one of the following ranges: approximately ½ inch to approximately 1 inch, approximately ½ inch to approximately 3 inches, approximately 1 inch to approximately 3 inches, and approximately 2 inches to approximately 4 inches (or within one of the following ranges: ½ to 1 inch, ½ to 3 inches, 1 to 3 inches, and 2 to 4 inches, inclusive). In alternative embodiments, the band's width 16 can be within one of the following ranges: approximately ⅛ inch to approximately ½ inch, approximately ¼ inch to approximately ½ inch, approximately ¼ inch to approximately 1 inch, approximately ½ inch to approximately 1 inch, approximately ½ inch to approximately 2 inches, and approximately 2 inches to approximately 3½ inches (or within one of the following ranges: ⅛ to ½ inch, ¼ to ½ inch, ¼ to 1 inch, ½ to 1 inch, ½ to 2 inches, and 2 to 3½ inches, inclusive).

A first axis 18 extends along the length 14 of the band 12. A second axis 20 extends parallel to a waist line of a person wearing an article of clothing 24 (see FIG. 2) that includes the pocket 10. In the first embodiment, a first angle 26 between the first axis 18 and second axis 20 can be within one of the following ranges: approximately 0 to approximately 15 degrees, approximately 0 to approximately 30 degrees, approximately 0 to approximately 60 degrees, approximately 15 degrees to approximately 30 degrees, approximately 15 degrees to approximately 60 degrees, approximately 30 degrees to approximately 60 degrees, approximately 15 degrees to approximately 90 degrees, and approximately 30 degrees to approximately 90 degrees (or within one of the following ranges: 0 to 15 degrees, 0 to 30 degrees, 0 to 60 degrees, 15 to 30 degrees, 15 to 60 degrees, 30 to 60 degrees, 15 to 90 degrees, and 30 to 90 degrees, inclusive). It is to be understood that these angular ranges are equally applicable to the other embodiments of the invention described hereinafter.

In the first embodiment of the invention, the band 12 can be secured to the inner pocket sheet 28 that is closer to the person or to the outer pocket sheet 30 that is further from the person. In an alternative embodiment, an inner pocket sheet 28 could be omitted and the outer pocket sheet 30 can be secured directly to the article of clothing 24 such that the article of clothing 24 acts as the inner pocket sheet 28; in such a case, the band can be secured to the article of clothing 24 or to the outer pocket sheet 30. Conversely, in another alternative embodiment, the outer pocket sheet 30 could be omitted and the inner pocket sheet 28 can be secured directly to the article of clothing 24 such that the article of clothing 24 acts as the outer pocket sheet 30; in such a case, the band can be secured to the article of clothing 24 or to the inner pocket sheet 28.

The pocket 10 can have an opening 32 that is straight or curved. The opening 32 can be at the top or sides of the pocket 10, including at the corners of the pocket 10. FIG. 1 shows an embodiment with a curved opening 32 at the top and left corner of the pocket 10. The opening 32 can have a midpoint 34. A third axis 36 extends through the midpoint 34 in the direction tangential to the curved opening 32. The band 12 can have a center point 38 along the band's length 14. A fourth axis 40 is formed between the midpoint 34 and the center point 38. In alternative embodiments, a second angle 42 formed between the third axis 36 and the fourth axis 40 can be within one of the following ranges: approximately 0 to approximately 90 degrees, approximately 30 degrees to approximately 90 degrees, approximately 45 degrees to approximately 90 degrees, approximately 60 degrees to approximately 90 degrees, and approximately 0 to approximately 60 degrees (or within one of the following ranges: 0 to 90 degrees, 30 to 90 degrees, 45 to 90 degrees, 60 to 90 degrees, and 0 to 60 degrees, inclusive). A first distance 48 is formed between the midpoint 34 and a first end 44 of the band's length 14. A second distance 50 is formed between the midpoint 34 and a second end 46 of the band's length 14. The second angle 42, first distance 48, and second distance 50 can vary, in alternative embodiments, as needed to position the band 12 within the pocket 10. The first distance 48 and second distance 50 can, but do not have to, be the same length. The first distance 48 can be greater than or less than the second distance 50.

In alternative embodiments of the invention, the band 12 can be secured to the pocket 10 such that the band 12 is under tension or not under tension, and the distance 14 between the first end 44 and second end 46 of the band's length 14 can be equal to, less than, or greater than the length 14 when the band 12 is not under tension.

The band 12 is made of a resilient material, such as, but not limited to, woven elastic, knitted elastic, elastic netting, neoprene, or another stretchable material comprising rubber or polymer. The band 12 can be made from combinations of materials. In alternative embodiments of the invention, the band 12 can have various elongation and/or elasticity factors. In alternative embodiments, the band 12 can include various textures on its outside surface, such as smooth, with raised dots or bumps, or ridged or ribbed.

In one or more embodiments of the invention, the band is formed from a material having an elastic modulus that is within one of the following ranges: approximately 0.00001 to approximately 1 gigapascals (GPa), approximately 0.0001 to approximately 0.01 gigapascals (GPa), approximately 0.0001 to approximately 0.1 gigapascals (GPa), approximately 0.0001 to approximately 0.145 gigapascals (GPa), approximately 0.001 to approximately 0.5 gigapascals (GPa), and approximately 0.001 to approximately 1 gigapascals (or within one of the following ranges: 0.00001 to 1 GPa, 0.0001 to 0.01 GPa, 0.0001 to 0.1 GPa, 0.0001 to 0.145 GPa, 0.001 to 0.5 GPa, and 0.001 to 1 GPa, inclusive).

In one or more embodiments, the retention device or band 12 is secured to the inner pocket sheet 28 or outer pocket sheet 30 using stitching or a suitable adhesive. In particular, the retention device or band 12 can be sewn to the inner pocket sheet 28 or outer pocket sheet 30 at each of its ends 44, 46. Alternatively, the ends 44, 46 of the retention device or band 12 could be attached to the inner pocket sheet 28 or outer pocket sheet 30 using a suitable adhesive or glue.

Figure 2:
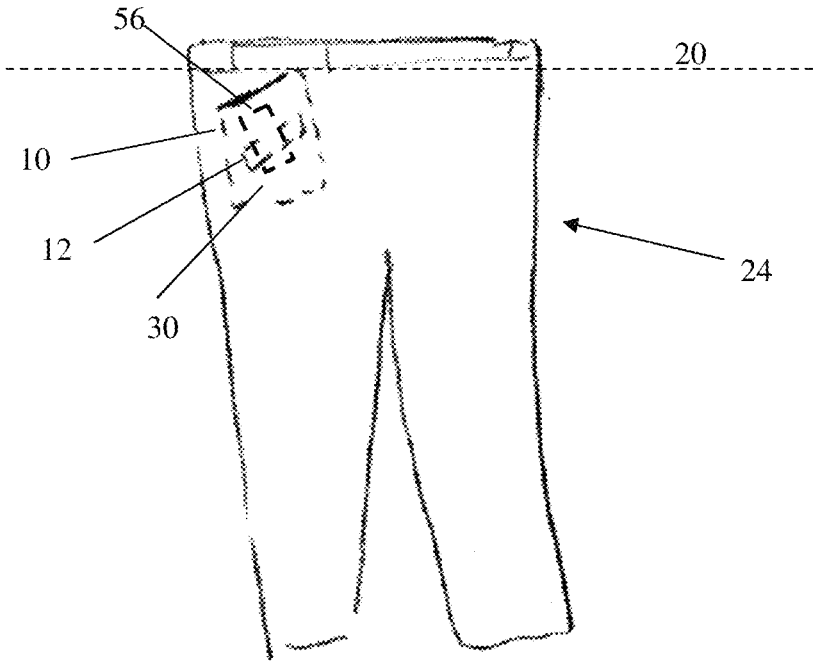
FIG. 2 is a perspective view of the first exemplary embodiment disposed in a pair of pants.

The band 12 can hold an item inside the pocket 10, such as item 56 (see FIG. 2). Items that can be held by the band include, but are not limited to, a phone, a personal digital assistant (PDA), a wallet, keys, an mp3 player, an iPod, a flat object, and a flat rectangular object.

Figure 4:
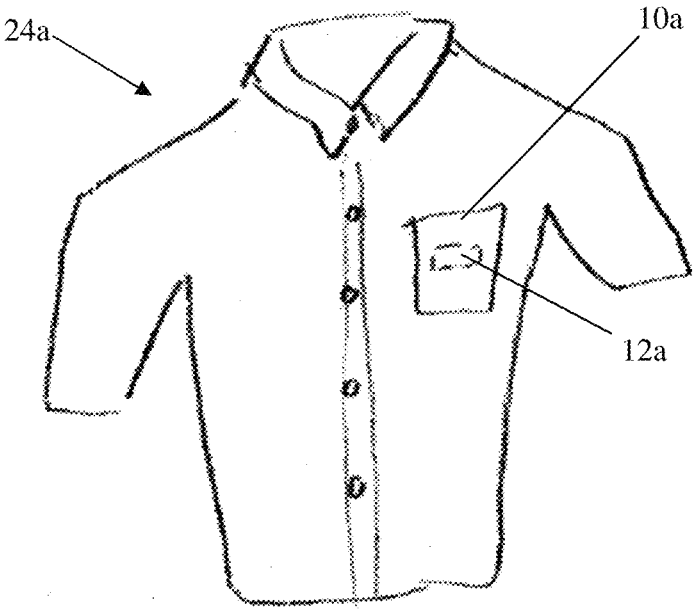
FIG. 4 is a perspective view of the second exemplary embodiment disposed on a shirt.

FIG. 2 shows a first embodiment of the invention with the article of clothing 24 being pants. FIG. 4 shows another embodiment in which the article of clothing 24 is a shirt. In alternative embodiments, the article of clothing 24 can also be, but is not limited to, shorts, a coat, a skirt, a dress, jeans, sweat pants, dress pants, a polo shirt, or a dress shirt.

Figure 3:
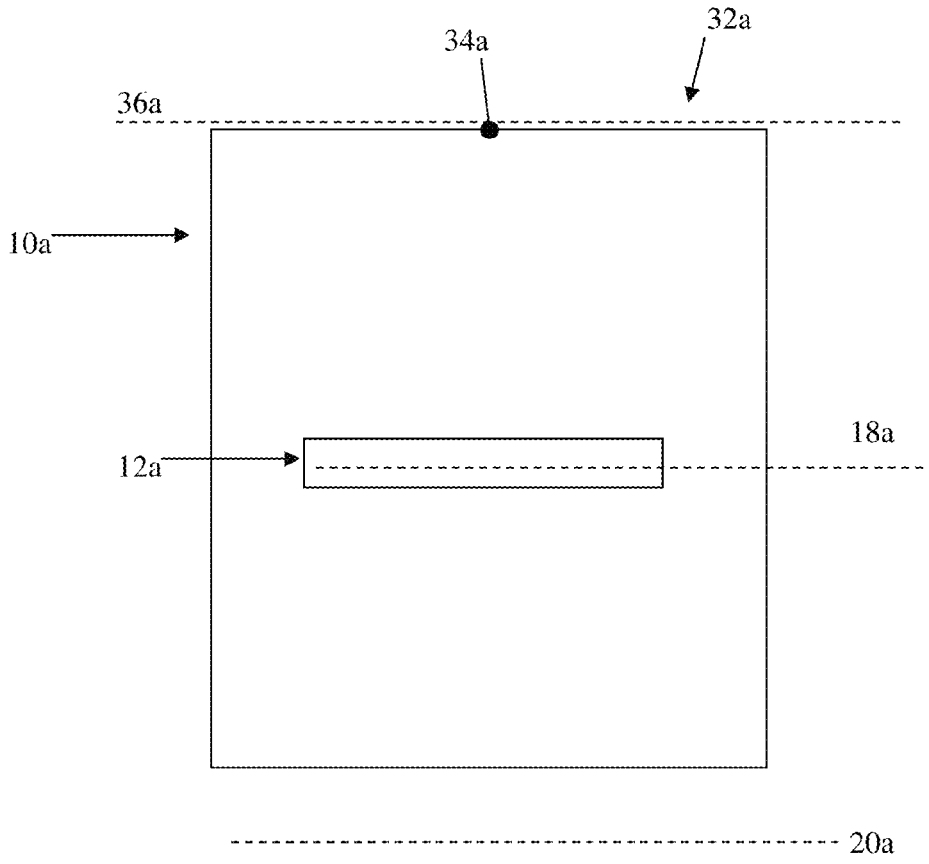
FIG. 3 is a front, planar view of a second exemplary embodiment of the invention.

FIG. 3 shows a second embodiment of the invention where the first axis 18*a* is substantially parallel to the second axis 20*a*. FIG. 4 shows the alternative embodiment of FIG. 3 on a shirt 24*a*. The pocket opening 32*a* of FIGS. 3 and 4 is straight and is at the top of the pocket 10*a*. As shown in these figures, the top and bottom edges of the retention device or band 12*a* are disposed generally parallel to the top and bottom edges of the pocket 10*a*. In other words, the first axis 18*a*, which is longitudinally disposed along the band 12*a*, is oriented substantially parallel to the second axis 20*a*, which is generally parallel to the bottom edge of the pocket 10*a*, and substantially parallel to the third axis 36*a*, which is generally parallel to the top edge of the pocket 10*a*. As illustrated in FIG. 3, the third axis 36*a* approximately passes through the midpoint 34*a* of the opening 32*a*.

Figure 5:
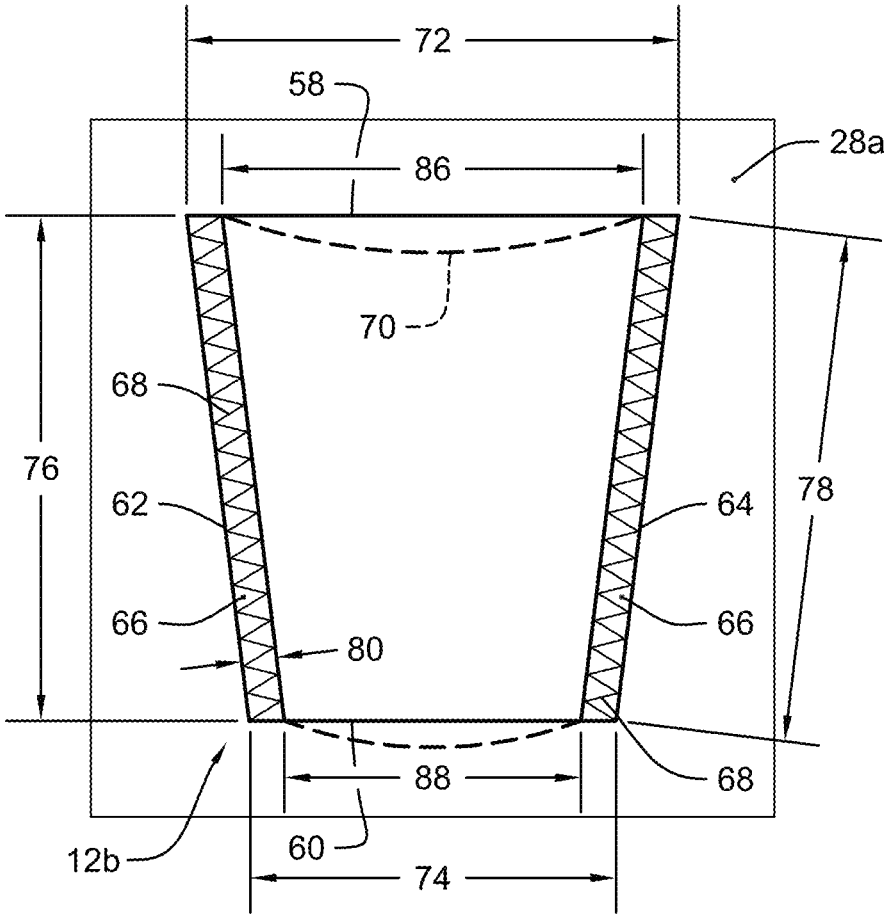
FIG. 5 is a front, planar view of a third exemplary embodiment of the invention.

In a third embodiment of the invention, the retention device or band 12*b* has a generally trapezoidal shape (e.g., see FIGS. 5-13), or more particularly, an inverted, generally trapezoidal shape wherein the top edge 58 (or upper base 58) of the trapezoid is greater in length than the bottom edge 60 (or lower base 60) of the trapezoid. The retention device 12*b* has a generally open top and bottom (i.e., the top edge 58 and bottom edge 60 of the retention device 12*b* is only stitched to the pocket sheet 28*a* in a stitching area 66). In this embodiment, the top edge 58 of the retention device 12*b* is disposed substantially parallel to the bottom edge 60 of the retention device 12*b*, while the side edges 62, 64 of the retention device 12*b* are angled inwardly from the top edge 58 to the bottom edge 60 of the device 12*b*. As shown in FIG. 5, a stitching area 66 is provided adjacent to each of the downwardly tapered sides 62, 64 of the retention device 12*b*. In this illustrated embodiment, it can be seen that each of the opposed sides 62, 64 of the retention device 12*b* are secured to a pocket sheet 28*a* using a zigzag stitch 68 comprising a suitable thread. Advantageously, this inverted trapezoidal or generally flat bottom V-shaped configuration of the retention device 12*b* enables the item 56, which is held within the device 12*b*, to be securely wedged into place. The downwardly tapered design of the third embodiment of the retention device 12*b* makes it much less likely that the item 56 will become inadvertently disengaged from the retention device 12*b*. As such, an item 56 will not fall out of a person's pocket when the retention device 12*b* is utilized. It is to be understood that the orientation (e.g., the angular orientation) of the retention device or band 12 within the pocket 10 described in conjunction with the first embodiment above is equally applicable to the third embodiment of the retention device or band 12*b*.

In an exemplary embodiment of the invention, with reference to FIG. 5, the top edge 58 has a length 72 of approximately three and three-quarter (3¾) inches, the bottom edge 60 has a length 74 of approximately three (3) inches, the retention device 12*b* has a height 76 of approximately three (3) inches, and each side of the retention device 12*b* has a width 78 of approximately three and one-quarter (3¼) inches. In the exemplary embodiment, each stitching area 66 has a width 80 of approximately one-quarter (¼) of an inch. As such, the interior receiving space 84 of the retention device 12*b* (see FIG. 12), which is disposed between the oppositely disposed stitching areas 66, has a top edge length 86 of approximately three and one-quarter (3¼) inches and a bottom edge length 88 of approximately two and one-half (2½) inches.

Figure 6:
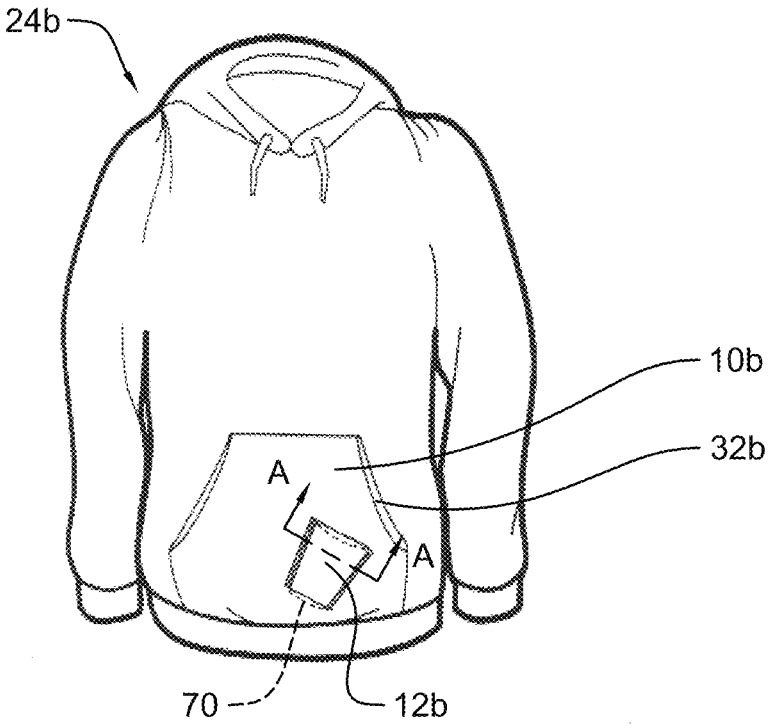
FIG. 6 is a perspective view of the third exemplary embodiment of the invention disposed in a first position in a pocket of a hooded sweatshirt, wherein the retention device is oriented in an angled position.
Figure 7:
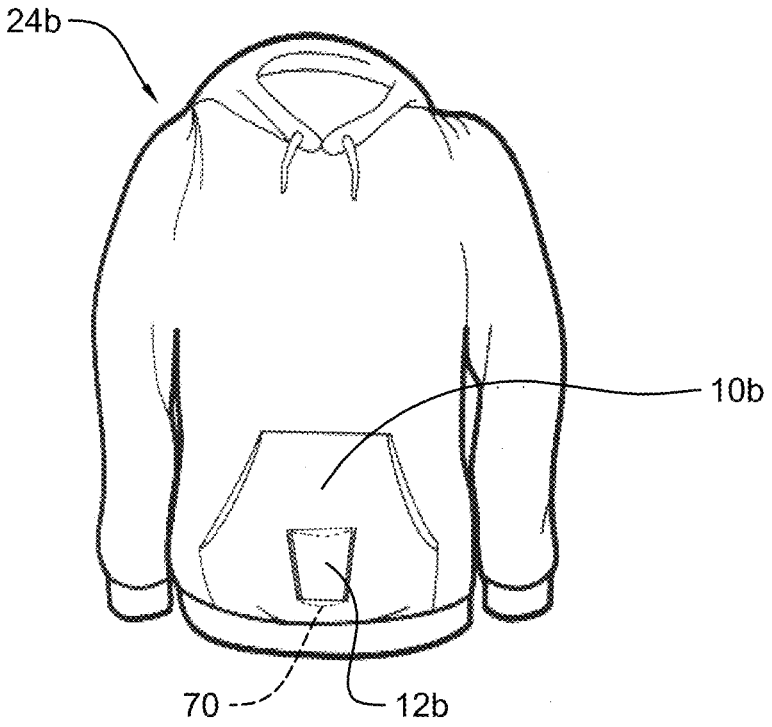
FIG. 7 is a perspective view of the third exemplary embodiment of the invention disposed in a second position in a pocket of a hooded sweatshirt, wherein the retention device is oriented in a generally upright position.

In FIG. 6, the retention device or band 12*b* is shown in a first position in a pocket 10*b* of a hooded sweatshirt 24*b*. As illustrated in this figure, the retention device 12*b* is angularly disposed within the pocket 10*b* of the hooded sweatshirt 24*b* so as to facilitate the insertion of an item 56 into the retention device 12*b* after the item 56 passes through the pocket opening 32*b*. The dashed lines 70 in FIGS. 5 and 6 diagrammatically illustrate the protruding nature of the retention device 12*b* from the inner sheet of the pocket 10*b*, as well as its deformability. The item 56 is received within the space 84 between the inner surface of the retention device 12*b* and the outer surface of the inner sheet 28*a* of pocket 10*b* (see FIG. 12). The retention device 12*b* is shown in a second position in a pocket 10*b* of a hooded sweatshirt 24*b* in FIG. 7. Rather than being angularly disposed as illustrated in FIG. 6, the retention device 12*b* of FIG. 7 is oriented in a generally upright position (i.e., the top and bottom edges of the retention device 12*b* are generally parallel to the top and bottom edges of the pocket 10*b*.

Figure 8:
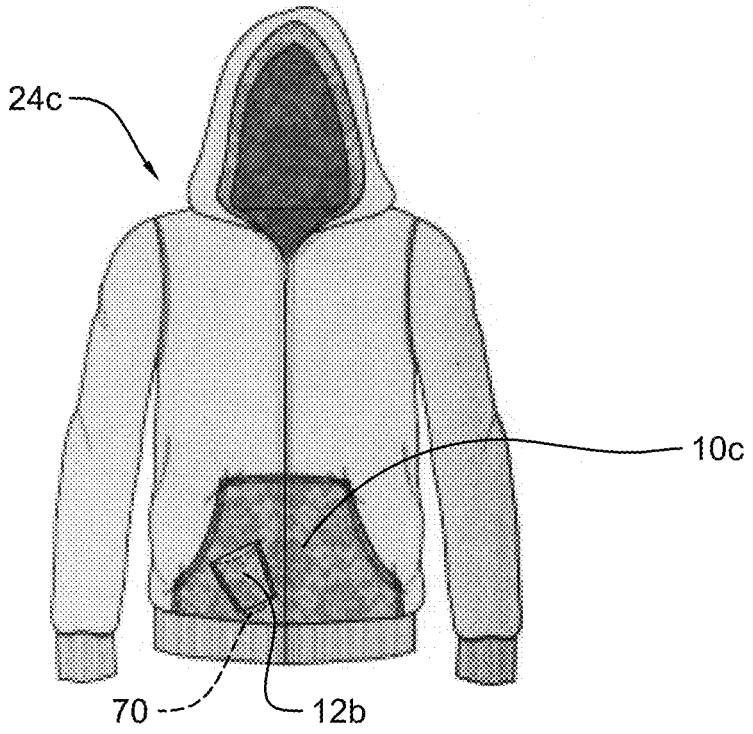
FIG. 8 is a perspective view of the third exemplary embodiment of the invention disposed in a pocket of a hooded jacket.
Figure 9:
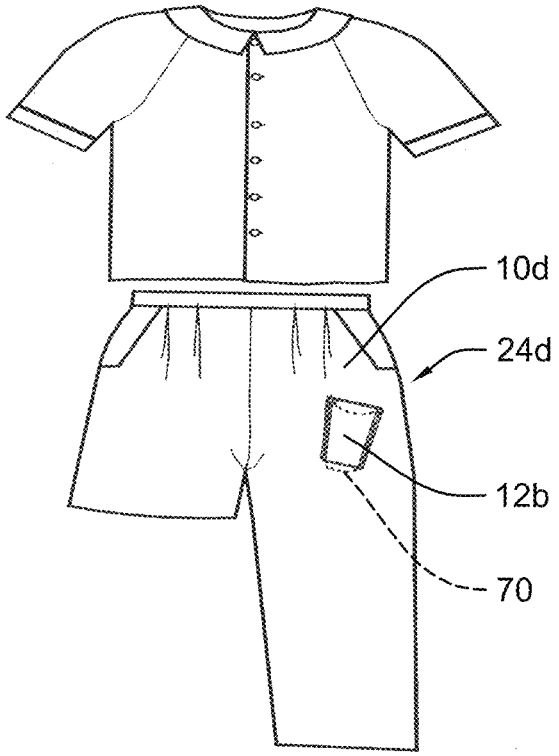
FIG. 9 is a perspective view of the third exemplary embodiment of the invention disposed in a pocket of a pair of pants.
Figure 10:
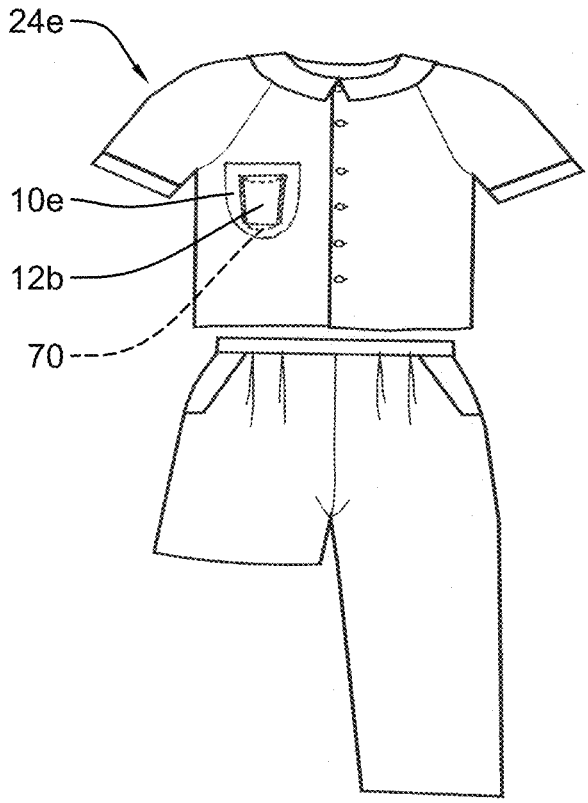
FIG. 10 is a perspective view of the third exemplary embodiment of the invention disposed in a pocket of a shirt.
Figure 11:
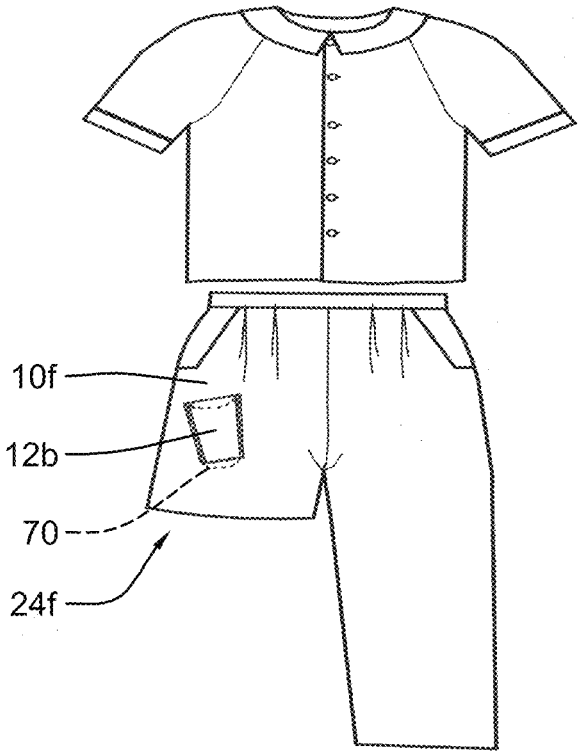
FIG. 11 is a perspective view of the third exemplary embodiment of the invention disposed in a pocket of a pair of shorts.

Referring to FIG. 8, it can be seen that the retention device or band 12*b* is angularly disposed within the pocket 10*c* of a hooded jacket 24*c*. In FIG. 9, the retention device or band 12*b* is angularly disposed within the pocket 10*d* of a pair of pants 24*d*. In FIG. 10, the retention device 12*b* is oriented in a generally upright position in the pocket 10*e* of a shirt 24*e* (i.e., the top and bottom edges of the retention device 12*b* are generally parallel to the top and bottom edges of the shirt pocket 10*e*). In FIG. 11, the retention device or band 12*b* is angularly disposed within the pocket 10*f* of a pair of shorts 24*f*.

Figure 12:
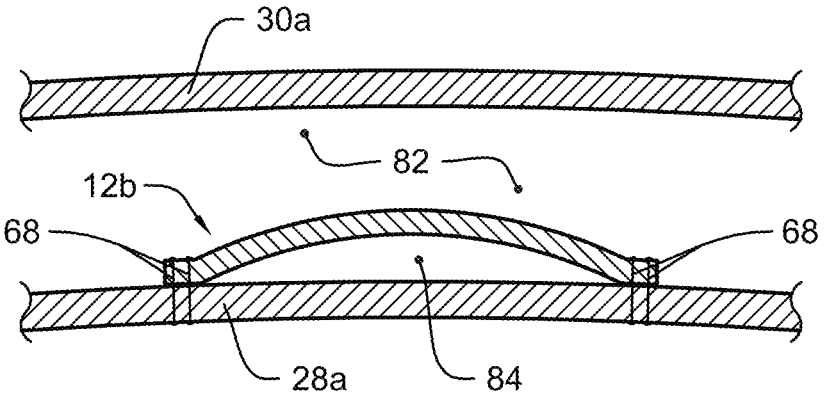
FIG. 12 is a transverse sectional view of the third exemplary embodiment of the invention, which is cut along the cutting-plane line A-A in FIG. 6.

In FIG. 12, a transverse sectional view of the third embodiment of the invention is illustrated. This transverse section is cut along the cutting-plane line A-A in FIG. 6, but it is to be understood that this section is typical for the third embodiment of the invention. As shown in FIG. 12, the inner pocket sheet 28*a* and the outer pocket sheet 30*a* are spaced apart from one another by a gap 82 (i.e., at least portions of each sheet 28*a*, 30*a* are spaced from the one another by a gap 82, wherein the geometric configuration of the gap 82 depends on the exact manner in which the pliable sheets 28*a*, 30*a* of fabric are deformed on the article of clothing). Referring again to FIG. 12, it can be seen that the middle portion of the retention device 12*b* is spaced apart from the inner pocket sheet 28*a* so as to define a securement space 84 between the retention device 12*b* and inner pocket sheet 28*a* (i.e., at least part of the middle portion of the retention device 12*b* is spaced apart from the inner pocket sheet 28*a*, the geometric configuration of the securement space 84 depends on the exact manner in which the pliable retention device 12*b* is deformed relative to the inner pocket sheet 28*a*).

Figure 13:
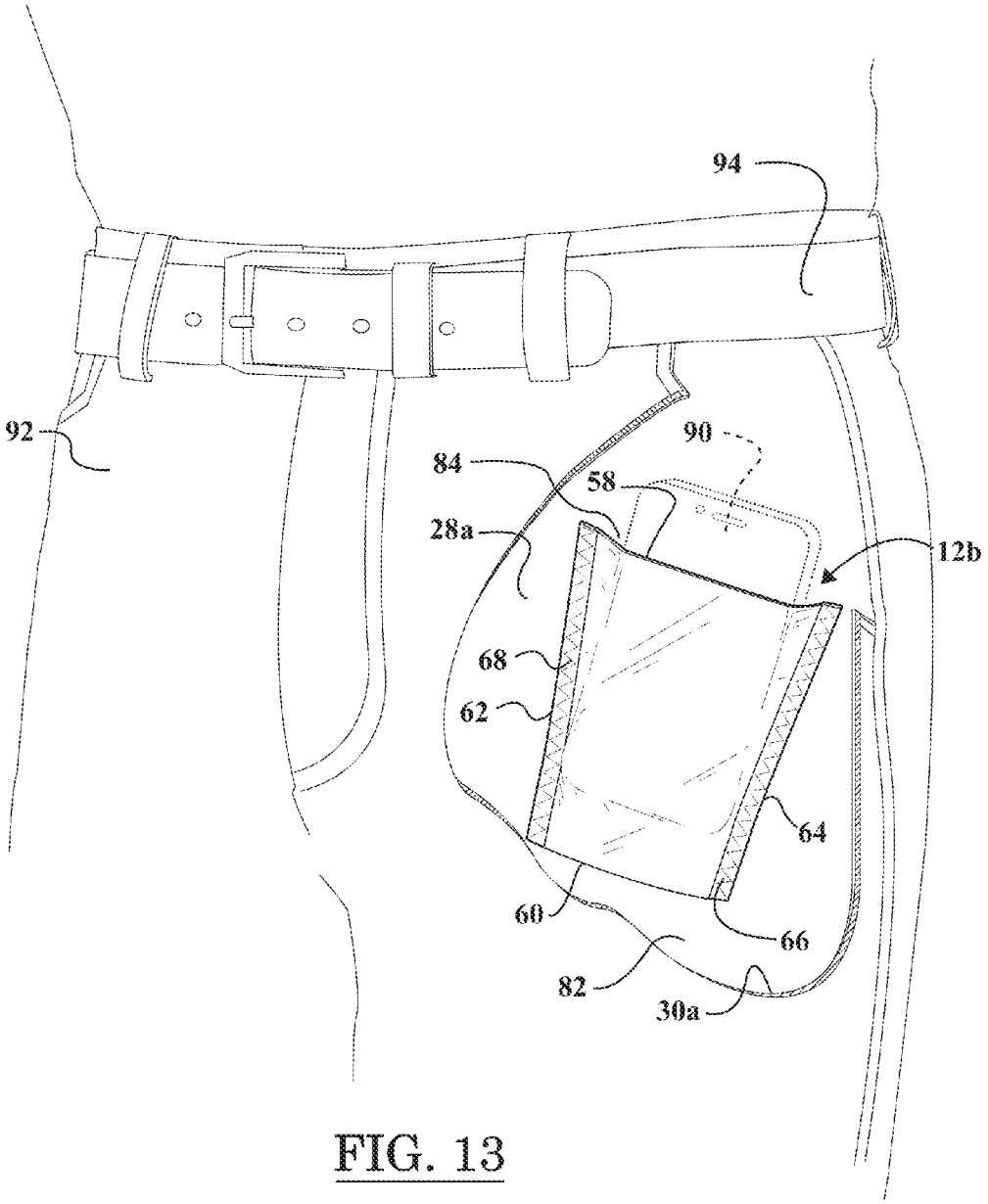
FIG. 13 is an enlarged, cutaway perspective view of the third exemplary embodiment of the invention disposed in a pocket of a pair of pants, wherein the outer layer of the pocket is shown cutaway so as to more clearly reveal the details of the pocket retention device.

In FIG. 13, the retention device or band 12*b* is shown inside the pocket of a pair of pants 92. The pocket of the pants 92 is disposed just beneath the belt 94 of the pants. As illustrated in FIG. 13, the retention device 12*b* is disposed between the inner pocket sheet 28*a* and the outer pocket sheet 30*a*, which are spaced apart from another by the gap 82. The retention device 12*b* is attached to the inner pocket sheet 28*a* of the pocket by the side stitching areas 66 with zigzag stitching 68. As depicted in FIG. 13, the interior receiving space 84 of the retention device 12*b* is securely holding an object 90 (e.g., a smartphone 90) therein. When the object 90 is inserted into the interior receiving space 84, the elastic material forming the retention device 12*b* is designed to elastically deform so as to allow the object 90 to be snuggly engaged by the retention device 12*b*.

It is readily apparent that the aforedescribed embodiments of the pocket retention devices 12, 12*a*, 12*b* and the associated articles of clothing containing the same offer numerous advantages. First, the articles of clothing with the retention structures 12, 12*a*, 12*b* disposed in the pockets thereof are capable of securely retaining objects within the confines of the pockets so as to prevent the objects from becoming inadvertently dislodged therefrom. Secondly, the pocket retention structures 12, 12*a*, 12*b* described herein can be easily integrated into the pockets of various articles of clothing. Finally, the pocket retention structures 12, 12*a*, 12*b* are compact, and thus, does not occupy an undue portion of the overall pocket volumes.

Any of the features or attributes of the above described embodiments and variations can be used in combination with any of the other features and attributes of the above described embodiments and variations as desired. For example, the retention device orientations, materials, and material properties described in conjunction with the first exemplary embodiment are equally applicable to other embodiments of the invention described herein.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed and the best mode contemplated for carrying out this invention, but that the invention will include all embodiments falling within the scope of the appended claims. Further, the "invention" as that term is used in this document is what is claimed in the claims of this document. The right to claim elements and/or sub-combinations that are disclosed herein as other inventions in other patent documents is hereby unconditionally reserved.

The invention claimed is:

1. An article of clothing comprising, in combination:

a pocket structure, said pocket structure including a first sheet of fabric at least partially spaced apart from a second sheet of fabric, said first and second sheets of fabric together at least partially defining a semi-enclosed volume; and a retention device disposed between said first and second sheets of fabric, said retention device having a top edge, a bottom edge, a first side portion, a second side portion, and a middle portion, said first and second side portions of said retention device being attached to one of said first and second sheets of fabric by respective first and second attachment areas of said first and second side portions, said middle portion of said retention device being at least partially spaced apart from the one of said first and second sheets of fabric to which said retention device is attached so as to define an inwardly tapered securement space between said retention device and said one of said first and second sheets of fabric, said inwardly tapered securement space being generally open at said top edge of said retention device so as to permit the passage of a device into said inwardly tapered securement space, and said inwardly tapered securement space having a cross-sectional area that continually decreases from said top edge of said retention device to said bottom edge of said retention device so that said device is held within said inwardly tapered securement space in a wedged manner, said first and second attachment areas being separated from one another by said inwardly tapered securement space, and said retention device being formed from a resilient material such that, when said device is inserted into said inwardly tapered securement space, said retention device elastically deforms so as to snuggly engage said device being held in said inwardly tapered securement space.

2. The article of clothing according to claim 1, wherein said bottom edge of said retention device is generally open so as to permit said device to protrude slightly from said bottom edge of said retention device.

3. The article of clothing according to claim 1, wherein said retention device has a generally inverted trapezoidal shape.

4. The article of clothing according to claim 3, wherein said retention device further comprises side edges extending between said top edge and said bottom edge, said side edges being inwardly tapered from said top edge to said bottom edge.

5. The article of clothing according to claim 1, wherein said retention device has a generally flat bottom V-shape.

6. The article of clothing according to claim 1, wherein said second sheet of fabric is an inner sheet of fabric on said article of clothing, and said retention device is attached to said second sheet of fabric.

7. The article of clothing according to claim 6, wherein said retention device is attached to said second sheet of fabric by means of stitching in said first and second attachment areas of said first and second side portions.

8. The article of clothing according to claim 1, wherein said first sheet of fabric is an outer sheet of fabric on said article of clothing, and said retention device is attached to said first sheet of fabric.

9. The article of clothing according to claim 8, wherein said retention device is attached to said first sheet of fabric by means of stitching in said first and second attachment areas of said first and second side portions.

10. The article of clothing according to claim 1, wherein said article of clothing is selected from the group consisting of: pants, a shirt, a hooded sweatshirt, shorts, a coat, a hooded jacket, a skirt, a dress, jeans, sweat pants, dress pants, a polo shirt, and a dress shirt.

11. A pocket on an article of clothing, said pocket comprising:

a wall, said wall at least partially closing a volume; and a retention member having a top edge, a bottom edge, a first side portion, a second side portion, and a middle portion, said first and second side portions of said retention member being fixed to said wall in said volume by respective first and second attachment areas of said first and second side portions, said middle portion of said retention member being at least partially spaced apart from said wall to which said retention member is attached so as to define an inwardly tapered securement space between said retention member and said wall, said inwardly tapered securement space being generally open at said top edge of said retention member so as to permit the passage of a device into said inwardly tapered securement space, and said inwardly tapered securement space having a cross-sectional area that continually decreases from said top edge of said retention member to said bottom edge of said retention member so that said device is held within said inwardly tapered securement space in a wedged manner, said first and second attachment areas being separated from one another by said inwardly tapered securement space, and said retention member being formed from a resilient material such that, when said device is inserted into said inwardly tapered securement space, said retention member elastically deforms so as to snuggly engage said device being held in said inwardly tapered securement space.

12. The pocket according to claim 11, wherein said retention member has a generally inverted trapezoidal shape.

13. The pocket according to claim 11, wherein said retention member has a generally flat bottom V-shape.

14. A clothing apparatus comprising:

a pocket including at least one side wall; and a resilient band having a top edge, a bottom edge, a first side portion, a second side portion, and a middle portion, said first and second side portions of said resilient band being secured to said at least one side wall of said pocket by respective first and second attachment areas of said first and second side portions, said middle portion of said resilient band being at least partially spaced apart from said at least one side wall to which said resilient band is attached so as to define an inwardly tapered securement space between said resilient band and said at least one side wall, said inwardly tapered securement space being generally open at said top edge of said resilient band so as to permit the passage of a device into said inwardly tapered securement space, and said inwardly tapered securement space having a cross-sectional area that continually decreases from said top edge of said resilient band to said bottom edge of said resilient band so that said device is held within said inwardly tapered securement space in a wedged manner, said first and second attachment areas being separated from one another by said inwardly tapered securement space, and said resilient band being formed from a resilient material such that, when said device is inserted into said inwardly tapered securement space, said resilient band elastically deforms so as to snuggly engage said device being held in said inwardly tapered securement space.

15. The clothing apparatus according to claim 14, wherein the length of said resilient band under tension or without tension is within one of the following ranges: (i) approximately ½ to approximately 1 inch; (ii) approximately ½ to approximately 3 inches; (iii) approximately 1 to approximately 3 inches; and (iv) approximately 2 to approximately 4 inches.

16. The clothing apparatus according to claim 15, wherein the width of said resilient band is within one of the following ranges: (i) approximately ⅛ to approximately ½ inch; (ii) approximately ¼ to approximately ½ inch; (iii) approximately ¼ to approximately 1 inch; (iv) approximately ½ to approximately 1 inch; (v) approximately ½ to approximately 2 inches; and (vi) approximately 2 to approximately 3½ inches.

17. The clothing apparatus according to claim 14, wherein said resilient material forming said resilient band is selected from the group consisting of: woven elastic, knitted elastic, elastic netting, neoprene, or another stretchable material comprising rubber or polymer.

18. The clothing apparatus according to claim 14, wherein said resilient material forming said resilient band has an elastic modulus that is within one of the following ranges: (i) approximately 0.00001 to approximately 1 gigapascals; (ii) approximately 0.0001 to approximately 0.01 gigapascals; (iii) approximately 0.0001 to approximately 0.1 gigapascals; (iv) approximately 0.0001 to approximately 0.145 gigapascals; (v) approximately 0.001 to approximately 0.5 gigapascals; and (vi) approximately 0.001 to approximately 1 gigapascals.

19. The clothing apparatus according to claim 14, wherein said article of clothing is selected from the group consisting of: pants, a shirt, a hooded sweatshirt, shorts, a coat, a hooded jacket, a skirt, a dress, jeans, sweat pants, dress pants, a polo shirt, and a dress shirt.

20. The article of clothing according to claim 1, wherein said first and second side portions of said retention device are only connected to one another by said middle portion of said retention device and said one of said first and second sheets of fabric.

* * * * *